US009122229B2

(12) United States Patent
Sugiyama

(10) Patent No.: US 9,122,229 B2
(45) Date of Patent: Sep. 1, 2015

(54) IMAGE FORMING APPARATUS WITH AN EXPOSED SHEET-PRESSING SWINGABLE PLATE

(71) Applicant: Kyoko Sugiyama, Obu (JP)

(72) Inventor: Kyoko Sugiyama, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/949,497

(22) Filed: Jul. 24, 2013

(65) Prior Publication Data

US 2014/0029975 A1 Jan. 30, 2014

(30) Foreign Application Priority Data

Jul. 24, 2012 (JP) ..... 2012-163827

(51) Int. Cl.
*G03G 15/00* (2006.01)
*G03G 21/16* (2006.01)

(52) U.S. Cl.
CPC ..... *G03G 21/1619* (2013.01); *G03G 15/00* (2013.01); *G03G 21/16* (2013.01)

(58) Field of Classification Search
CPC ..... G03G 21/1619
USPC ..... 399/107
See application file for complete search history.

(56) References Cited

U.S. PATENT DOCUMENTS 5,787,323 A * 7/1998 Nomura et al. ..... 399/111
5,899,601 A * 5/1999 Yamaguchi et al. ..... 399/110
7,177,566 B2 2/2007 Noda et al.
7,245,869 B2 * 7/2007 Kim et al. ..... 399/377
8,208,180 B2 6/2012 Osakabe et al.
8,794,620 B2 8/2014 Wakakusa et al.
2004/0156031 A1 * 8/2004 Noda et al. ..... 355/405
2005/0069340 A1 * 3/2005 Noda et al. ..... 399/107
2005/0201792 A1 * 9/2005 Park et al. ..... 399/393
2006/0113724 A1 * 6/2006 Ito et al. ..... 271/162
2006/0263127 A1 11/2006 Kim et al.
2008/0075502 A1 * 3/2008 Tada et al. ..... 399/111

(Continued)

FOREIGN PATENT DOCUMENTS

CN 1591210 A 3/2005
CN 1865103 A 11/2006

(Continued)

OTHER PUBLICATIONS

Jun. 5, 2015—(CN) The First Office Action—App 201310313741.0.

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

An image forming apparatus, including a pair of resin-made main frames arranged to face each other along a first horizontal direction; a photosensitive member to carry an image in a developer agent thereon; an exposure device to expose the photosensitive member to light; a resin-made first auxiliary frame fixed to the main frames at one side along a second horizontal direction and configured to form a conveying path for the sheet; a second auxiliary frame to support the exposure device and fixed to the main frames at the other side along the second horizontal direction; and a swingable plate arranged in an intermediate position between the main frames with a lower surface thereof being exposed to outside, and swingably supported by lower end positions of the main frames on the other side along the second horizontal direction, is provided.

18 Claims, 8 Drawing Sheets

(56) References Cited

U.S. PATENT DOCUMENTS

| | | | | |
|---|---|---|---|---|
| 2009/0194935 | A1 | 8/2009 | Wakakusa et al. | |
| 2010/0014127 | A1 | 1/2010 | Osakabe et al. | |
| 2010/0247136 | A1* | 9/2010 | Seto | 399/107 |
| 2012/0043714 | A1* | 2/2012 | Hamaguchi et al. | 271/10.09 |
| 2013/0207337 | A1* | 8/2013 | Tokisawa et al. | 271/126 |

FOREIGN PATENT DOCUMENTS

| | | | | |
|---|---|---|---|---|
| CN | 101397094 | A | | 4/2009 |
| CN | 101497403 | A | | 8/2009 |
| JP | 61-193457 | | | 12/1986 |
| JP | 04-092069 | A | | 3/1992 |
| JP | 06-167841 | A | | 6/1994 |
| JP | 2004-264840 | A | | 9/2004 |
| JP | 2005-077735 | A | | 3/2005 |
| JP | 2008195479 | A | * | 8/2008 |
| JP | 4-383807 | B2 | | 12/2009 |
| JP | 2010-028465 | A | | 2/2010 |
| JP | 2013-067508 | A | | 4/2013 |
| JP | 2013-067509 | A | | 4/2013 |

* cited by examiner

IMAGE FORMING APPARATUS WITH AN EXPOSED SHEET-PRESSING SWINGABLE PLATE

CROSS REFERENCE TO RELATED APPLICATION

This application claims priority from Japanese Patent Application No. 2012-163827, filed on Jul. 24, 2012, the entire subject matter of which is incorporated herein by reference.

BACKGROUND

1. Technical Field

An aspect of the present invention relates to an electro-photographic image forming apparatus capable of forming an image on a sheet.

2. Related Art

An image forming apparatus for forming an image on a recording sheet may often have a metal frame assembly, including a pair of side plates arranged at laterally opposite sides (e.g., right and left sides) and a bottom plate connecting lower ends of the side plates.

The image forming apparatus may also have a sheet-feed tray, on which sheets to be conveyed in the image forming apparatus are stacked. The sheet-feed tray may be arranged on the bottom plate of the frame assembly. In other words, a bottom of the sheet-feed tray may be redundantly covered by the bottom plate.

SUMMARY

The present invention is advantageous in that an image forming apparatus having a frame assembly without the redundancy is provided.

According to an aspect of the present invention, an image forming apparatus is provided. The image forming apparatus includes a pair of main frames made of resin, the main frames arranged to face each other along a first horizontal direction; a photosensitive member arranged in a position between the main frames and configured to carry an image which is to be formed on a sheet in a developer agent thereon; an exposure device arranged in a position between the main frames and configured to expose the photosensitive member to light; a first auxiliary frame made of resin and being fixed to the main frames at one side along a second horizontal direction, which is orthogonal with respect to the first horizontal direction, and configured to form a conveying path for the sheet to be conveyed toward the photosensitive member; a second auxiliary frame configured to support the exposure device and fixed to the main frames at the other side along the second horizontal direction; and a swingable plate, on which the sheet to be conveyed toward the photosensitive member is placed, the swingable plate being arranged in an intermediate position between the main frames and swingably supported by lower end positions of the main frames on the other side along the second horizontal direction, the swingable plate having a lower surface of the swingable plate to be exposed to outside.

BRIEF DESCRIPTION OF THE ACCOMPANYING DRAWINGS

Figure 5:
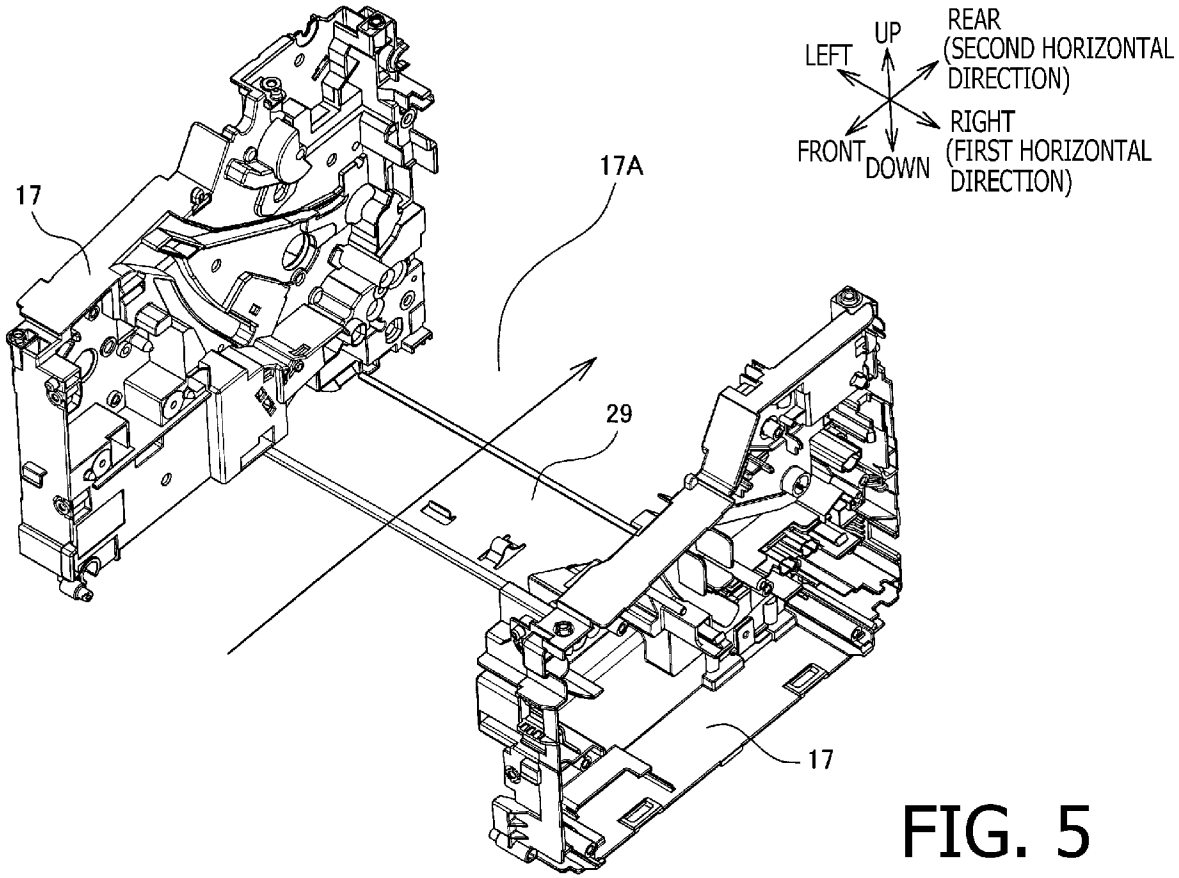

FIG. 5 is a perspective view of a paired main frames 17 and a restrictive member 29 in the image forming apparatus 1 according to the embodiment of the present invention.

Figure 6:
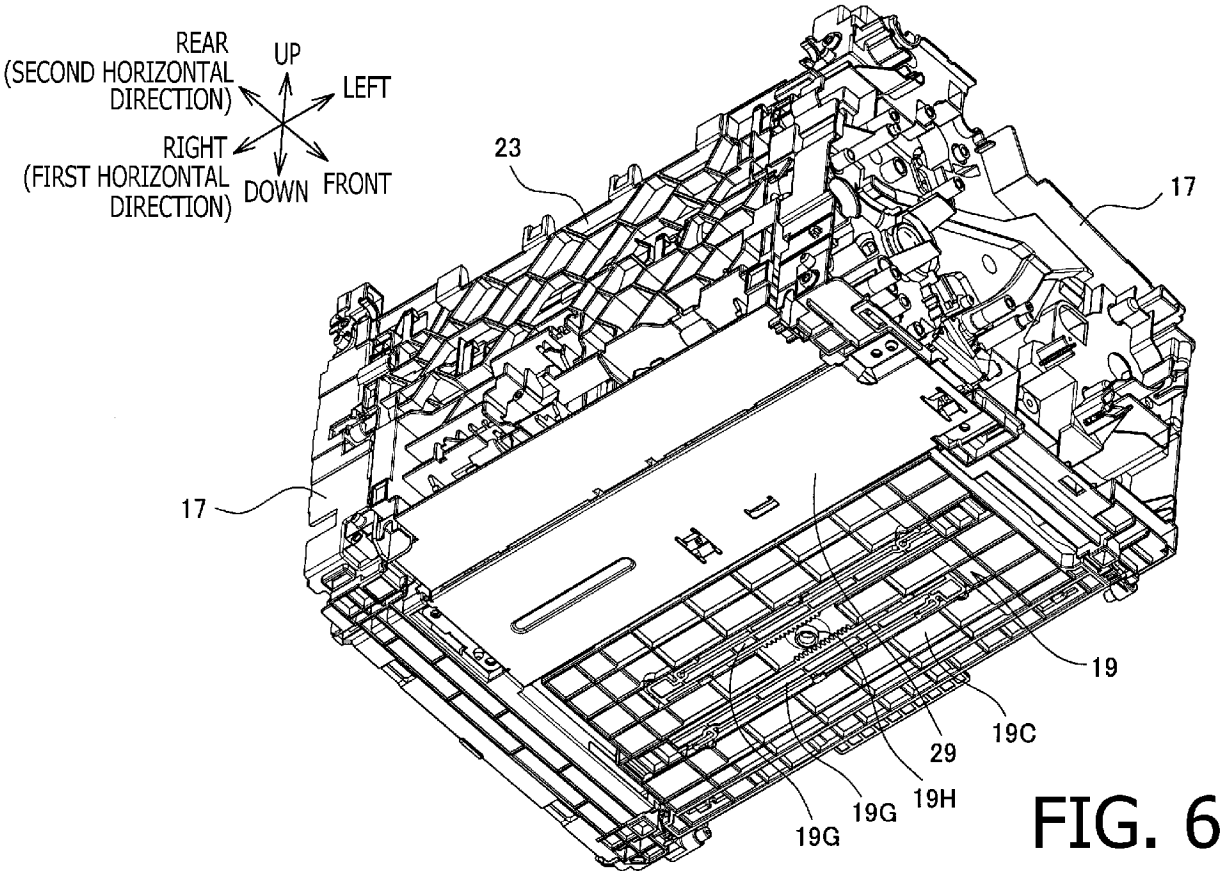

FIG. 6 is a perspective view of the frame assembly, viewed from a lower angle, in the image forming apparatus 1 according to the embodiment of the present invention.

Figures 7A, 7B, 7C:
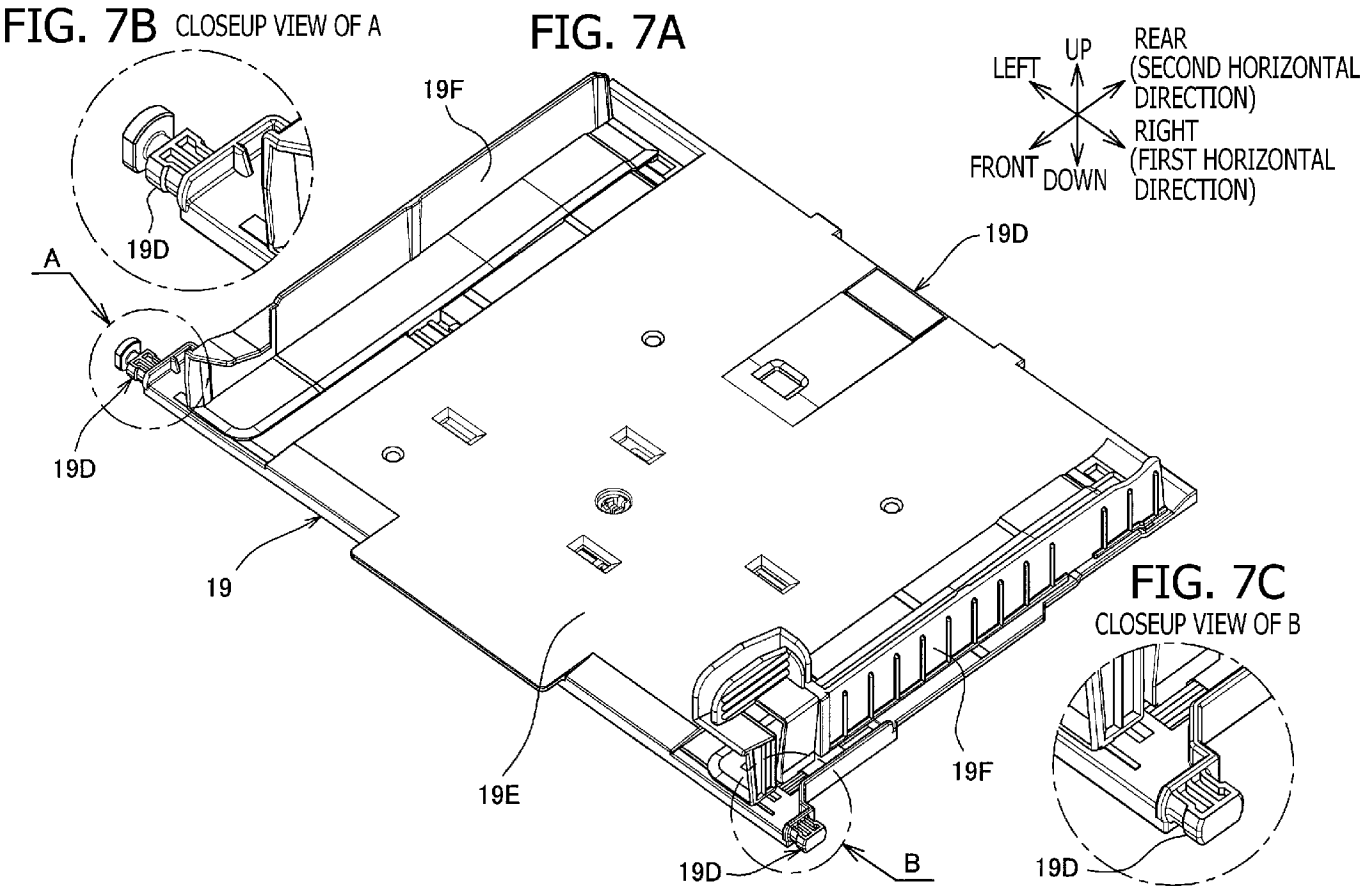

FIG. 7A is a perspective view of a swingable plate unit 19 in the image forming apparatus according to the embodiment of the present invention. FIGS. 7B-7C are enlarged views of shafts 19D in the image forming apparatus 1 according to the embodiment of the present invention.

Figure 8A:
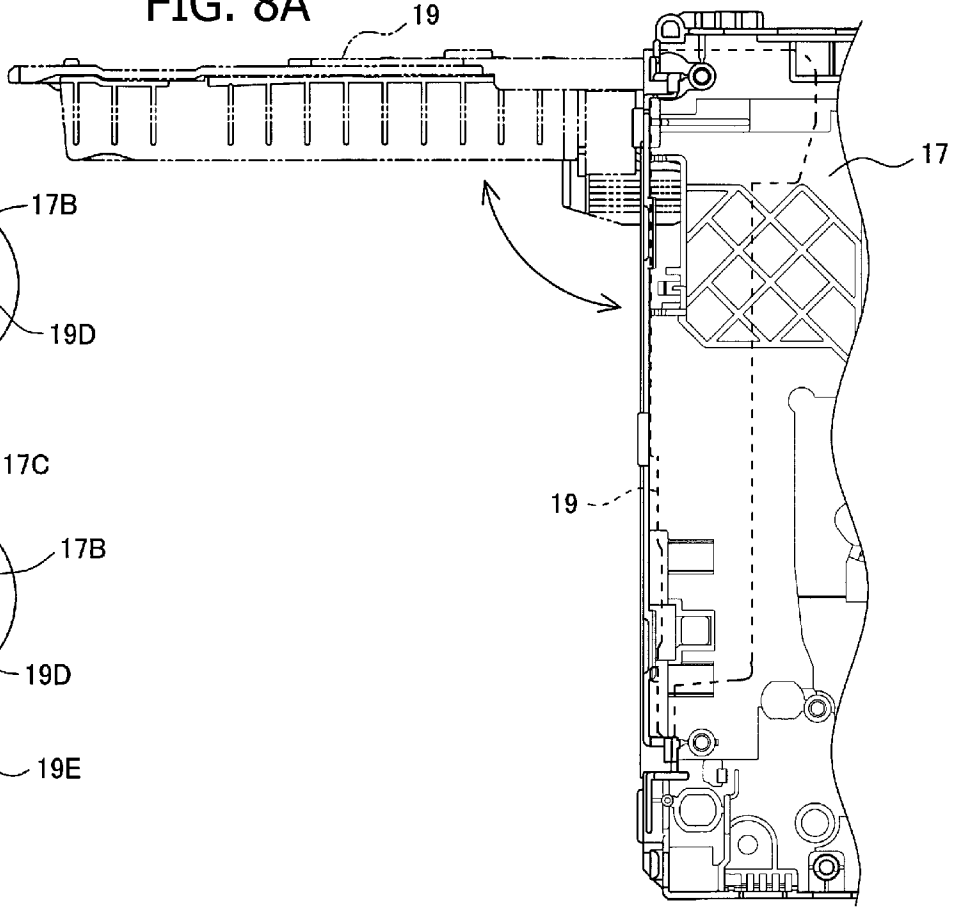
Figure 8B:
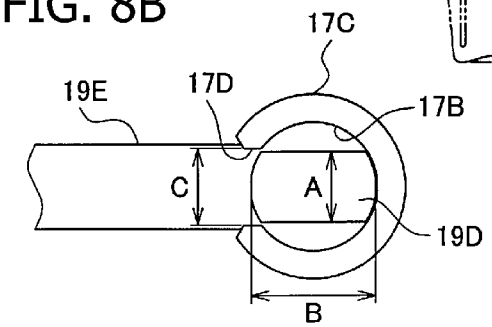
Figure 8C:
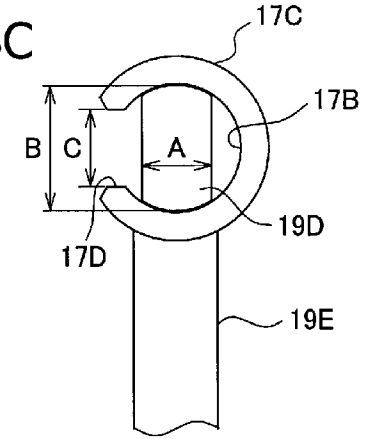

FIG. 8A is a partial view of the main frame 17 with the swingable plate unit 19 in the image forming apparatus 1 according to the embodiment of the present invention. FIGS. 8B-8C are side views of the shaft 19D and a shaft hole 17B in the image forming apparatus according to the embodiment of the present invention.

DETAILED DESCRIPTION

Hereinafter, an embodiment of the present invention will be described with reference to the accompanying drawings. It is noted that various connections are set forth between elements in the following description. These connections in general, and unless specified otherwise, may be direct or indirect, and this specification is not intended to be limiting in this respect.

1. Overall Configuration of Image Forming Apparatus

An overall configuration of the image forming apparatus 1 according to the embodiment will be described with reference to FIG. 1. In the following description, directions concerning the image forming apparatus 1 will be referred to in accordance with orientation indicated by arrows in the drawings. The image forming apparatus 1 being a monochrome image forming apparatus includes a chassis 3, which accommodates an image forming unit 5 inside. On a front face of the chassis 3, a swingable sheet-feeder cover 3A is attached. On top of the chassis 3, a swingable sheet-ejection cover 3B is attached.

Figure 1:
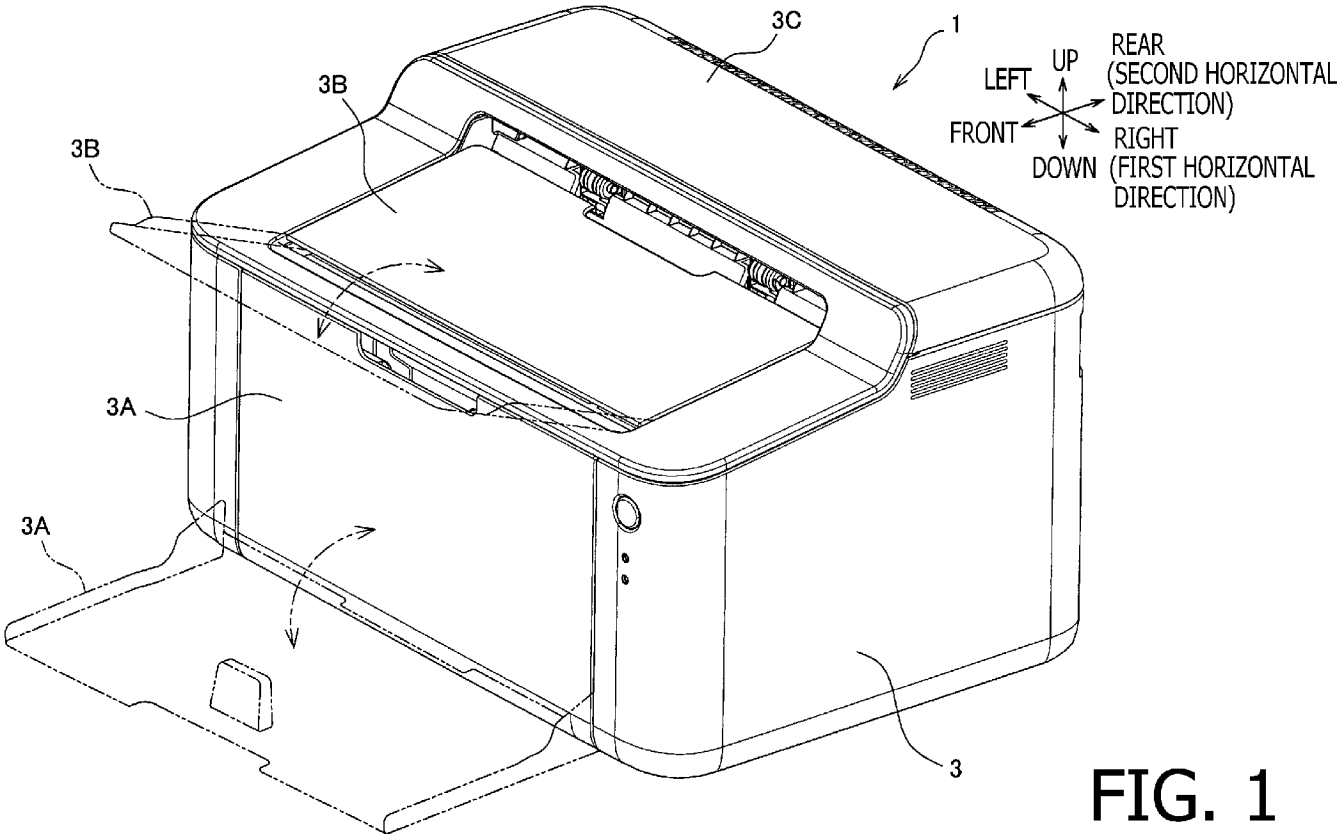
FIG. 1 is an external perspective view of an image forming apparatus 1 according to an embodiment of the present invention.

When an image is formed on a sheet of paper, the sheet-feeder cover 3A and the sheet-ejection cover 3B are pivoted frontward to positions indicated in double-dotted chain lines in FIG. 1 to be opened so that the sheet is placed on the sheet-feeder cover 3A being open. When an image forming operation starts, the sheet placed on the sheet-feeder cover 3A is fed in the chassis 3 to the image forming unit 5. When the image is formed on the sheet, the sheet with the image is ejected out of the chassis 3 and released on the sheet-ejection cover 3B.

Figure 2:
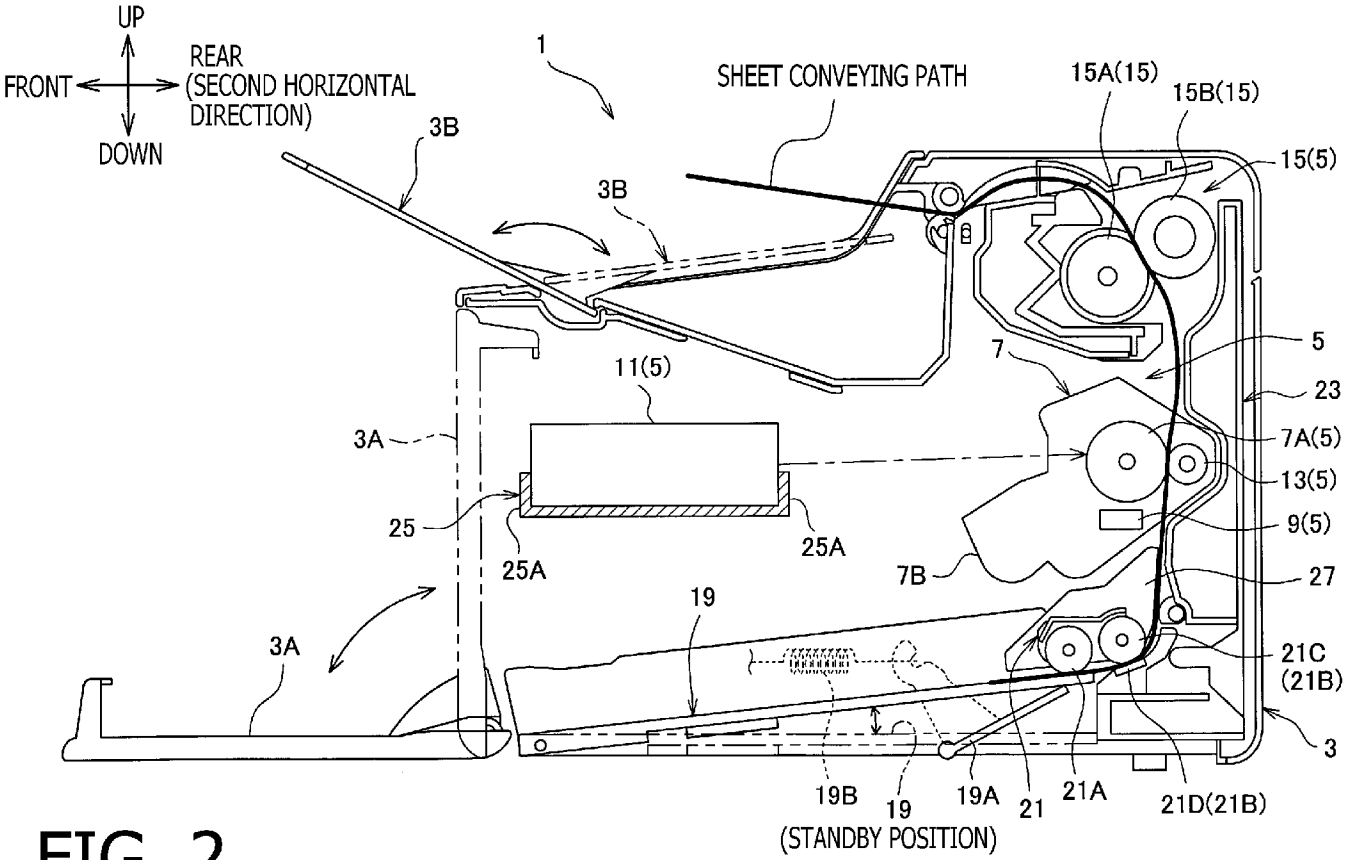
FIG. 2 is a cross-sectional view of the image forming apparatus 1 according to the embodiment of the present invention.

The image forming unit 5 is configured to form the image on the sheet in an electro-photographic method and includes, as shown in FIG. 2, a photosensitive drum 7A, a charger 9, an exposure device 11, a transfer roller 13, and a fixing device 15. The photosensitive drum 7A carries an image formed in a developer agent on a circumference thereof. The charger 9 electrically charges the circumference of the photosensitive drum 7A. The exposure device 11 emits laser light to expose the circumference of the photosensitive drum 7A to the light and forms a latent image on an area exposed to the laser light on the circumference of the photosensitive drum 7A. The transfer roller 13 transfers the image formed in the developer agent and carried on the circumference of the photosensitive drum 7A onto the sheet. The fixing device 15 fixes the image transferred on the sheet.

The photosensitive drum 7A is contained in a casing 7B and is rotatable. The casing 7B further contains the developer agent and a developer device (not shown), which supplies the developer agent to the photosensitive drum 7A. The photosensitive drum 7A, the casing 7B, and the developer device are included in a processing unit 7.

The processing unit 7 is detachably attached to a body of the image forming apparatus 1. The body of the image forming apparatus I includes paired main frames 17 (see FIG. 3), the chassis 3, and other components, which are not to be removed or detached by a user in regular use. The main frames 17 are a pair of panels, which are arranged on lateral (right and left) sides of the image forming unit 5 including the processing unit 7. The processing unit 7 is detachably attached to the main frames 17.

The fixing device 15 includes, as shown in FIG. 2, a heat roller 15A and a pressure roller 15B. The heat roller 15A is rotated and heats the sheet being conveyed. The pressure roller 15B is driven along with the rotation of the heat roller 15A and urges the sheet against the heat roller 15A.

A feeder unit 21 conveys the sheet placed on the sheet-feeder cover 3A and a swingable plate unit 19 toward the photosensitive drum 7A. The feeder unit 21 includes a pickup roller 21A and a separator 21B.

The pickup roller 21A is arranged to be in contact with one of sheets stacked on the sheet-feeder cover 3A, in particular, one of the sheets at one end (e.g., top end) of the stack along a stacking direction, and is rotated to move the sheet at the one end.

The separator 21B includes a separator roller 21C and a separator pad 21D. The separator roller 21C contacts the one of the sheets at the one end of the stack from the same side as the pickup roller 21A with respect to the sheet and rotates. The separator pad D is arranged in a position to face the separator roller 21C across the sheet and applies conveying resistance to the sheet. The separator 21B thus separates the one of the sheets at the one end from the stacked other sheets and forwards the separated sheet toward the image forming unit 5.

Figure 3:
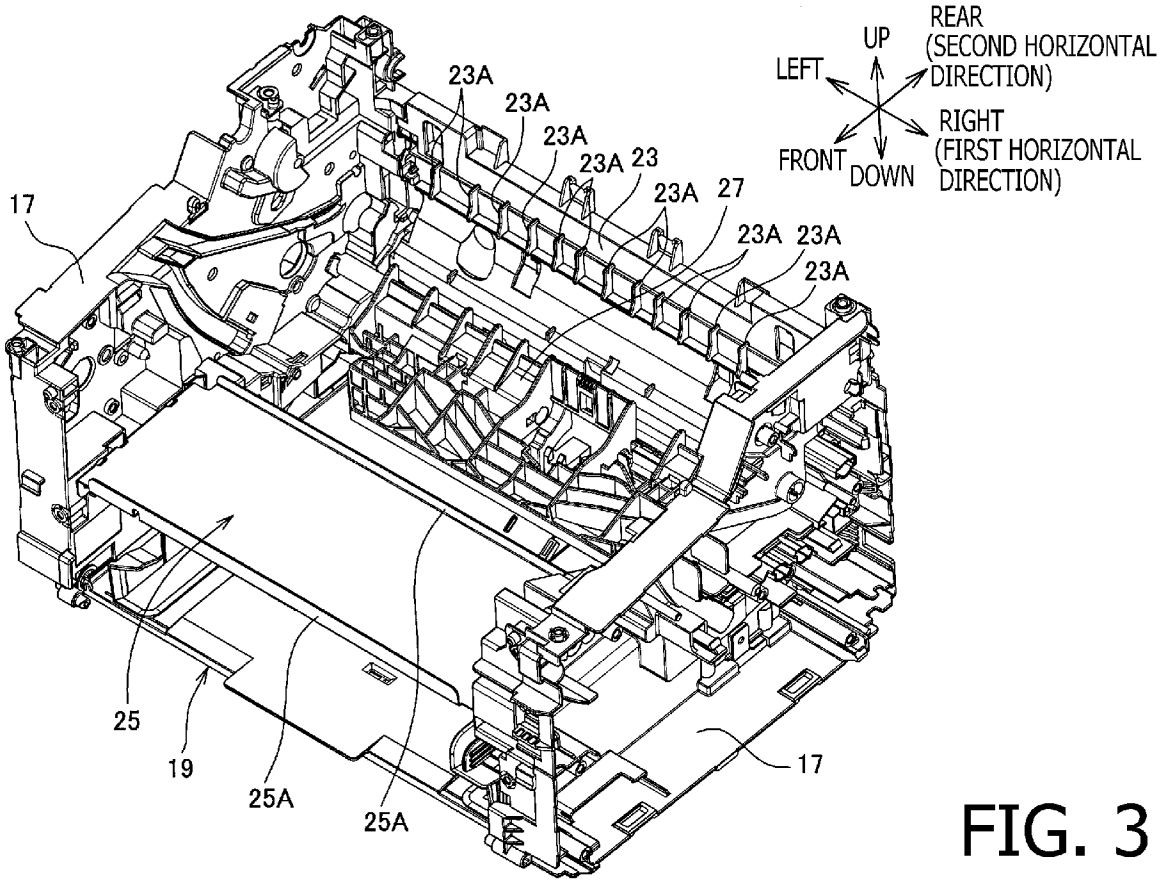
FIG. 3 is a perspective view of a frame assembly in the image forming apparatus 1 according to the embodiment of the present invention.

The swingable plate unit 19 is, as shown in FIG. 3, arranged in an intermediate position between the main frames 17. The swingable plate unit 19 is a flat plate unit, which is swingably attached to lower end portions of the main frames 17. As shown in FIG. 2, the swingable plate unit 19 is swingably movable to press the sheet placed on the swingable plate unit 19 against the pickup roller 21A.

The swingable plate unit 19 is swingably moved in cooperation with start and stop rotating motions of the pickup roller 21A. In the image forming apparatus 1, as shown in FIG. 2, a spring 19B providing resilient force is arranged. The spring 19B applies the resilient force, which can move the swingable plate unit 19 swingably toward the pickup roller 21A. The resilient force is applied to the swingable plate unit 19 via the uplifting piece 19A.

Meanwhile, a driving system (not shown) applies opposing force against the resilient force of the spring 19B to the lifting piece 19A, when the pickup roller 21A is not rotating, so that the swingable plate unit 19 is maintained standing by inactive at a position indicated by double-dotted lines shown in FIG. 2. The opposing force from the driving system may be hereinafter referred to as maintaining force, and the position of the swingable plate unit 19 indicated by the double-dotted lines may be referred to as a standby position.

When the sheet is fed, the driving system releases the maintaining force and allows the swingable plate unit 19 to move from the standby position toward the pickup roller 21A to an activated position, which is indicated by solid lines in FIG. 2. When the swingable plate unit 19 is in the activated position, the driving system transmits rotating force to the pickup roller 21A.

When feeding of the sheet is completed, the driving system blocks the transmission of the rotating force to the pickup roller 21A and applies the maintaining force to the lifting piece 19A to place the swingable plate unit 19 back in the standby position.

2. Configuration of Frame Assembly 2.1 Structure of Frames

Figure 4:
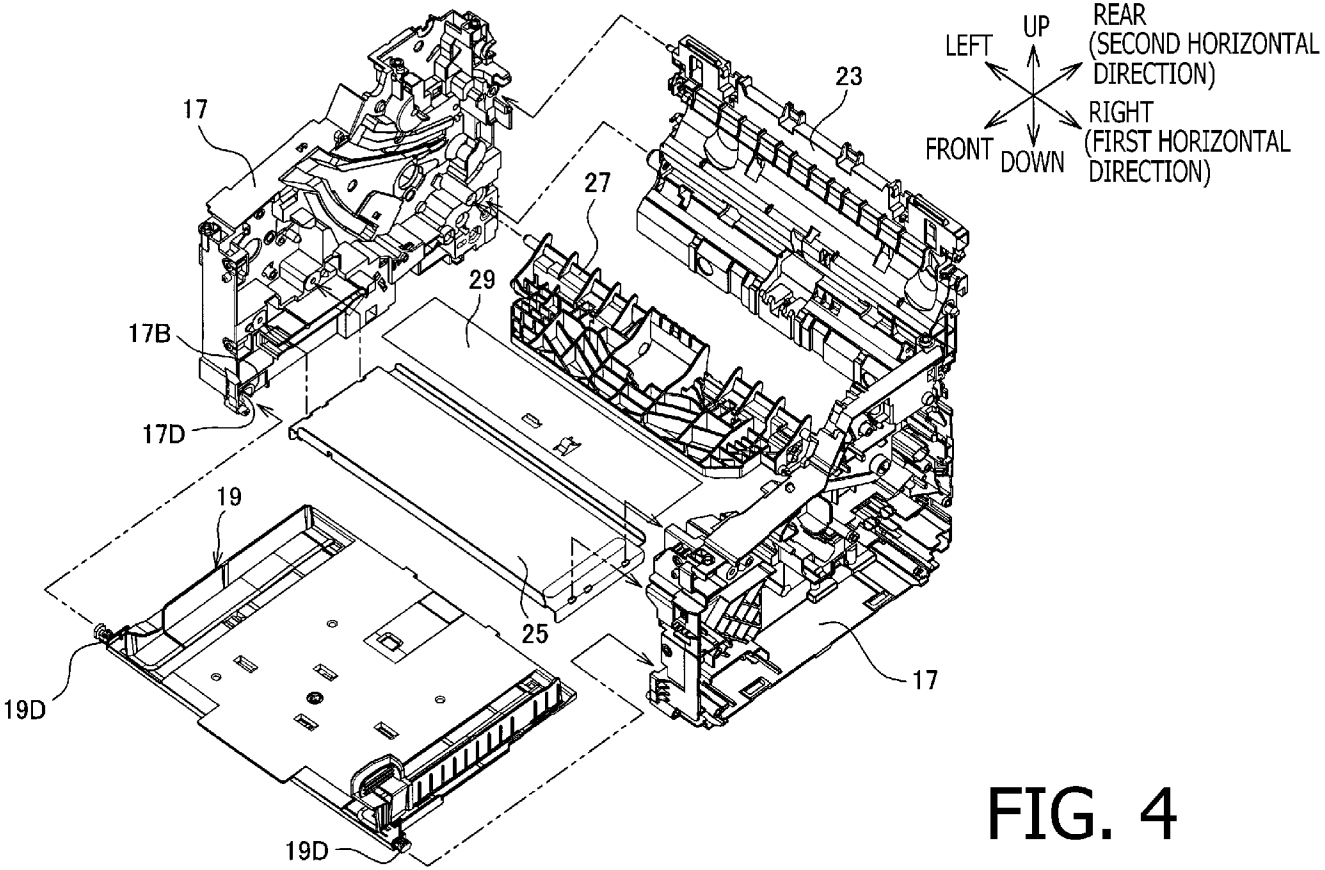
FIG. 4 is an exploded view of the frame assembly in the image forming apparatus 1 according to the embodiment of the present invention.

The paired main frames 17 are made of resin and, as shown in FIGS. 3 and 4, arranged on each lateral position (e.g., on right and left sides) along a first horizontal direction to face each other. In the present embodiment, the first horizontal direction coincides with a widthwise direction (i.e., right-to-left or left-to-right) of the image forming apparatus 1. Each of the main frames 17 is formed in a shape of a panel with a plurality of enhancing surfaces.

In an intermediate position between the paired main frames 17, the image forming unit 5 including the exposure device 11 is arranged. In other words, the main frames 17 are arranged on both widthwise sides of the image forming apparatus 5. Therefore, as shown in FIG. 5, a room 17A spreading along a second horizontal direction, which is orthogonal with respect to the first horizontal direction, is formed by the main frames 17. In the present embodiment, the second horizontal direction coincides with a direction of depth (i.e., front-to-rear or rear-to-front) of the image forming apparatus 1. The room 17A may also be referred to as a "communication area 17A" hereinafter.

In the image forming apparatus 1 of the present embodiment, the image forming unit 5 is disposed in the communication area 17A, and the sheet is conveyed through the communication area 17A. On one side along the second horizontal direction, e.g., a rear side, in the communication area 17A, a resin-made first auxiliary frame 23 is disposed (see FIGS. 3 and 4).

The first auxiliary frame 23 extends to bridge between the main frames 17 and is fixed to the main frames 17 at widthwise ends thereof by a fastening means such as screws (not shown). The first auxiliary frame 23 serves as a part of a sheet conveying path to direct the sheet, when the sheet is conveyed from the feeder unit 21 to the photosensitive drum 7A.

More specifically, the first auxiliary frame 23 turns the sheet, which has been conveyed to the one side (e.g., the rear side) in the communication area 17A from the other side (e.g., a front side) along the second horizontal direction, upward to guide to the photosensitive drum 7A.

In order to guide the sheet smoothly in the sheet conveying path, the first auxiliary frame 23 is formed to have at least one protrusive strip 23A, which projects inward to have open end thereof extending along the sheet conveying direction, which thereat coincides with the second horizontal direction. In the present embodiment, the first auxiliary frame 23 is integrally formed to have a plurality of protrusive strips 23A. The plurality of protrusive strips 23A are arranged to be spaced apart from each other along the first horizontal direction. The main frames 17 and the first auxiliary frame 23 may be made of polystyrene resin.

In a position between the main frames 17, on the other (front) side of the communication area 17A, a second auxiliary frame 25 to support the exposure device 11 is arranged. The second auxiliary frame 25 extends to bridge between the main frames 17 along the first horizontal direction and is fixed to the main frames 17 at widthwise ends thereof by a fastening means such as screws (not shown).

The second auxiliary frame 25 is made of metal, such as SPCC (cold-rolled steel plate). On both ends of the second auxiliary frame 25 along the second horizontal direction, peripheries 25A protruding vertically and extending along the first horizontal direction are formed. The second auxiliary frame 25 is pressed-formed integrally with the peripheries 25A.

While the peripheries 25A are formed on each side of the second auxiliary frame 25 along the second horizontal direction and protrude upward, the second auxiliary frame 25 has a cross-sectional shape of a top-open box or a tray.

In a position opposite from the first auxiliary frame 23 across the sheet conveying path, a third auxiliary frame 27 to support the feeder unit 21 is arranged. The third auxiliary frame 27 is made of resin. As shown in FIG. 3, the third auxiliary frame 27 extends to bridge between the main frames 17 along the first horizontal direction and is fixed to the main frames 17 at widthwise ends thereof by a fastening means such as screws (not shown).

In a lower end position with respect to the main frames 17, as shown in FIG. 5, a restrictive member 29 is arranged. The restrictive member 29 restricts the swingable plate unit 19 from swinging downward from a predetermined position.

The restrictive member 29 is arranged in a position to face a lower surface 19C of the swingable plate unit 19. The restrictive member 29 extends to bridge between the main frames 17 along the first horizontal direction and is fixed to lower ends of the main frames 17 at widthwise ends thereof.

The restrictive member 29 is a flat strip of metal such as SPCC. The uplifting piece 19A is swingably supported on the restrictive member 29 at a swing axis thereof. In this regard, the predetermined position of the swingable plate unit 19 coincides with the standby position. The predetermined position of the swingable plate unit 19 refers to a position, in which the swingable plate unit 19 is stored to lie flat in between the main frames 17, even when the image forming apparatus 1 is uplifted. In this regard, it may be assumed that the spring 19B or other driving mechanism is not yet installed in the image forming apparatus 1 since, for example, the image forming apparatus 1 is in midst of an assembly operation.

Meanwhile, as shown in FIG. 6, the restrictive member 29 at the lower ends of the main frames 17 is arranged in a position closer to the first auxiliary frame 23 and to the rear ends of the main frames 17 along the second horizontal direction rather than the front ends of the main frames 17. In this regard, the lower surface 19C of the swingable plate unit 19 is exposed to the outside at least at a portion closer to the other (front) side of the image forming apparatus 1 along the second horizontal direction. Namely, the image forming apparatus 1 is not equipped with a covering to cover the internal structure on the front side at the bottom; therefore, the swingable plate unit 19 is exposed to the outside at the portion closer to the swing axis thereof (e.g., a front portion) while the portion closer to the rear side of the image forming apparatus 1 (e.g., a rear portion) is covered by the restrictive member 29.

2.2 Installable Structure of the Swingable Unit to the Main Frames

The swingable plate unit 19 is, as shown in FIGS. 7A-7C, swingably supported by the main frames 17 via paired shafts 19D, which are formed at the other (front) ends of the swingable plate unit 19 along the second horizontal direction.

The shafts 19D are protrusions protruding outward along the widthwise direction from widthwise ends of a flat-formed swingable panel 19E of the swingable plate unit 19.

Meanwhile, each of the main frames 17 is formed to have a shaft hole 17B (see FIG. 4), in which the shaft 19D of the swingable plate unit 19 is rotatably inserted. Thus, axial directions of the shafts 19D and the shaft holes 17B are in parallel with the widthwise direction of the image forming apparatus 1.

Each of the shaft holes 17B is formed to have a partly cylindrically-shaped bearing 17C, which is integral with the main frame 17 (see FIGS. 8B and 8C). The bearing 17C is formed to have a communication slit 17D, which is open along a direction orthogonal with respect to the axial direction of the shaft hole 17B to communicate an area inside the bearing 17C with the outside. Therefore, the bearing 17C has a shape of a partly open ring or a "C" from a view point along the axial direction.

Meanwhile, each of the shafts 19D is formed to have a cross-sectional shape of an oval having a first diameter A and a second diameter B to be allowed to enter or exit the shaft hole 17B through the communication slit 17D. More specifically, the first diameter A of the shaft 19D, which is one of outer diameters of the shaft 19D, is smaller than or equal to a dimension C of the opening in the communication slit 17D. The second diameter B, which is the other of the outer diameters of the shaft 19D and is orthogonal with respect to the first diameter A, is greater than the dimension C of the opening of the communication slit 17D and is smaller than or equal to an internal diameter of the shaft hole 17B.

The communication slit 17D is in an orientation to open along a direction orthogonal with respect to a level plane and communicates the inside and outside the bearing 17C along the vertical direction (see FIG. 4). Thus, the communicating direction of the communication slit 17D coincides with the vertical direction, and the communication slit 17D is open downward.

On the swingable panel 19E of the swingable plate unit 19, as shown in FIG. 7A, paired sheet guides 19F protruding upward from an upper surface of the swingable panel 19E are arranged. At least one of the sheet guides 19F is movable with respect to the upper surface of the swingable panel 19E along the widthwise direction.

Each of the sheet guides 19F has an upright surface, which extends long the sheet conveying direction. In the present embodiment, due to an effect of a synchronizing mechanism, the paired sheet guides 19F are both movable in synchronization with each other with respect to the upper surface of the swingable panel 19E along the widthwise direction.

The synchronizing mechanism may be, for example, a rack-and-gear system, which includes rack gears 19G and a pinion gear 19H (see FIG. 6). The rack gears 19G may be movable along the widthwise direction integrally with the sheet guides 19F via the pinion gear 19F, which is engaged with the rack gears 19G respectively.

2.3 Attaching the Swingable Unit to the Main Frames

The swingable plate unit 19 may be attached to the main frames 17 in the following steps.

Firstly, the first auxiliary frame 23, the second auxiliary frame 25, and the third auxiliary frame 27 are attached to the main frames 17 to form a subsidiary assembly. Next, the subsidiary assembly is arranged in an orientation shown in FIG. 8A to have the sheet conveying direction to coincide with the vertical direction.

As shown in FIG. 8A, with the communication slits 17D which communicates the inside and outside the shaft hole 17B horizontally, the shafts 19D are inserted in the shaft holes 1713 through the communication slits 17D. Thereby, when the swingable panel 19E is released from, for example, a worker's hand, the swingable panel 19E swings to a position shown in FIG. 8C, in which the swingable panel 19E aligns with the vertical direction due to weight of the swingable plate unit 19.

Next, the swingable plate unit 19 is stored in the position between the main frames 17, as indicated by broken lines in FIG. 8A, and the restrictive member 29 is attached to the main frames 17. Thereafter, the subsidiary assembly is arranged in an orientation to have the sheet conveying direction coincident with the level plane. In this regard, with the restrictive member 29 being attached to the lower ends of the main frames 17, the swingable plate unit 19 is prevented from swinging downward with respect to the lower edges of the main frames 17.

3. Features of the Image Forming Apparatus

As shown in FIG. 3, in the image forming apparatus 1, the first auxiliary frame 23 and the second auxiliary frame 25 connect the paired main frames 17 together. Therefore, it is not necessary to connect the main frames 17 at the bottom. In other words, a bottom plate to connect the lower ends of the main frames 17 can be omitted. Accordingly, as shown in FIG. 6, the lower surface 19C of the swingable plate unit 19 is exposed to the outside.

While the bottom plate is omitted, the swingable plate unit 19 can be placed in the position, which is otherwise occupied by the bottom plate. Therefore, the vertical dimension of the image forming apparatus 1 can be downsized to be smaller than the image forming apparatus with the bottom plate.

Further, while at least the main frames 17 and the first auxiliary frame 23 are made of resin, compared to an image forming apparatus, in which main frames are made of metal, manufacturing cost of the image forming apparatus 1 of the present embodiment can be lowered.

In the image forming apparatus 1 according to the present embodiment, the second auxiliary frame 25 is made of metal, while the second auxiliary frame 25 is required to be higher in dimension accuracy and in rigidity than the first and third auxiliary frames 23, 27 or the main frames 17. With the metal-made second auxiliary frame 25, the photosensitive drum 7A may be exposed in accurate positions, and an image forming quality of the image forming apparatus 1 can be maintained, while the image forming apparatus 1 may be downsized, and the manufacturing cost may be lowered.

In the image forming apparatus 1 according to the present embodiment, the first auxiliary frame 23 is formed to have the protrusive strips 23A, which protrude and extend along the sheet conveying direction. With the protrusive strips 23A, the first auxiliary frame 23 is prevented from being in surface contact with the sheet excessively in larger areas. At the same time, the first auxiliary frame 23 may be enhanced. In other words, while the conveying resistance of the sheet being conveyed is prevented from being increased, rigidity of the first auxiliary frame 23 may be improved.

In the image forming apparatus 1 according to the present embodiment, the first diameter A in the shaft 19D is smaller than or equal to the dimension C of the opening of the communication slit 17D, while the second diameter B which is orthogonal with respect to the first diameter dimension A is greater than the dimension C, and the communication slit 17D is formed in the orientation along the direction orthogonal with respect to the level plane.

With the above structure, the swingable plate unit 19 may be attached to the main frames 17, for example, in the following steps.

The main frames 17 are connected with each other by the first auxiliary frame 23 and the second auxiliary frame 25. Thereafter, the main frames 17 are placed in the orientation to have the second horizontal direction of the image forming apparatus 1 to coincide with the upright direction. In this regard, the orientation of the communication slit 17D coincides with the level plane.

With the main frames 17 in this orientation, the swingable plate unit 19 may be attached to the main frames 17 along a direction in parallel with the level plane. Thus, once the paired main frames 17 are connected together via the first auxiliary frame 23 and the second auxiliary frame 25, the swingable plate unit 19 may be easily attached to the main frames 17.

On the contrary, if the communication slit 17D was not formed in the shaft hole 17B, but the shaft hole 17B was formed in a solid cylindrical shape, the swingable plate unit 19 could not be attached to the main frames 17 after the main frames 17 are coupled to each other by the first auxiliary frame 23 and the second auxiliary frame 25.

In particular, if the shaft holes 17B are in the cylindrical shapes extending along the first horizontal direction to open inward, it is necessary that the main frames 17 are placed in the lateral positions with the intervening components, such as the swingable plate unit 19, held by jigs in between the main frames 19, while the first and second auxiliary frames 23, 25 are being fixed to the main frames 17, and the jigs must be removed thereafter.

However, with the shaft holes 17B having the communication slits 17D as described above, the swingable plate unit 19 can be attached to the main frames 17 without being held by jigs. And without the jigs, man-hours for assembling the image forming apparatus 1 can be reduced.

Further, in the image forming apparatus 1, the restrictive member 29 to restrict the swingable plate unit 19 from swinging downward from the predetermined position is arranged at the lower position of the main frames 17. Thereby, when the image forming apparatus I is uplifted, the swingable plate unit 19 is prevented from swinging downward, and the shafts 19D are prevented from slipping out of the shaft holes 17B.

More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first auxiliary frame 23 and the second auxiliary frame 25 may not necessarily be arranged in the intervening position between the main frames 17 but may be attached to front or rear edges of the main frames 17 along the sheet conveying direction.

For another example, the shafts 19D and the shaft holes 17B may not necessarily be formed in the swingable plate unit 19 and the main frames 17, respectively. The shafts 19D and the shaft holes 17B may be formed in the reversed positions, e.g., the shafts 19D may be formed in the main frames 17 and the bearings 17 may be formed in the swingable plate unit 19.

For another example, the second auxiliary frame 25 may not necessarily be made of metal but may be made of resin.

For another example, the third auxiliary frame 27 may not necessarily be arranged in the position opposite from the first auxiliary frame 23 across the sheet conveying path.

For another example, the feeder unit 21 may not necessarily have the pickup roller 21A and the separator roller 21C but may be, for example, equipped with the pickup roller 21A alone, and the separator roller 21C may be omitted. For another example, the feeder unit 21 may have a single roller, which can both pickup and separate.

For another example, the image forming apparatus 1 may not necessarily be the image forming apparatus of the monochrome electro-photographic type but may be, for example, an image forming apparatus of direct tandem type.

What is claimed is:

1. An image forming apparatus, comprising:

a pair of main frames made of resin, the main frames arranged to face each other along a first horizontal direction;

a photosensitive member arranged in a position between the main frames and configured to carry an image that is to be formed on a sheet in a developer agent thereon;

an exposure device arranged in a position between the main frames and configured to expose the photosensitive member to light;

a first auxiliary frame made of resin and being fixed to the main frames at one side along a second horizontal direction, which is orthogonal to the first horizontal direction, and configured to form a conveying path for the sheet to be conveyed toward the photosensitive member;

a second auxiliary frame configured to support the exposure device and fixed to the main frames at an other side along the second horizontal direction;

a pickup roller configured to convey the sheet toward the photosensitive member;

a swingable plate unit comprising a swingable panel on which the sheet to be conveyed toward the photosensitive member is placed, the swingable plate unit being arranged in an intermediate position between the main frames and swingably supported by lower end positions of the main frames on the other side along the second horizontal direction, the swingable panel providing a lower surface of the swingable plate unit to be exposed to outside, the lower surface being on an opposite side of the swingable panel from a side of the swingable panel on which the sheet to be conveyed toward the photosensitive member is placed, the swingable panel being arranged below the pickup roller and being movable between a position closer to the pickup roller and a position farther from the pickup roller; and a sheet-feeder cover pivotably attached to the pair of main frames at the other side along the second horizontal direction.

2. The image forming apparatus according to claim 1, wherein the second auxiliary frame is made of metal.

3. The image forming apparatus according to claim 1, wherein one of the main frames and the swingable plate unit has a pair of shafts, which are configured to be rotatably inserted in bearings formed in an other of the main frames and the swingable plate unit, each of the shafts having a first diameter and a second diameter orthogonal to the first diameter;

wherein axial directions of the shafts and the bearings are in parallel with the first horizontal direction;

wherein each of the bearings in the other of the main frames and the swingable plate unit has a communication slit, which communicates inside of the bearing with the outside;

wherein the first diameter of the shafts is smaller than or equal to a dimension of the communication slit, and the second diameter is greater than the dimension of the communication slit; and wherein a communicating direction, along which the communication slit communicates the inside of the bearing with the outside, is orthogonal with respect to a level plane.

4. The image forming apparatus according to claim 3, further comprising:

a restrictive member arranged at a lower position of the main frames and configured to restrict the swingable plate unit from swinging downward with respect to a predetermined position.

5. The image forming apparatus according to claim 4, wherein the restrictive member is arranged to extend along the first horizontal direction to bridge between the main frames in a position to face a part of the lower surface of the swingable plate unit and is fixed to the main frames.

6. The image forming apparatus according to claim 1, wherein a sheet guide, which protrudes upward from a plane of the swingable plate unit and is movable along the first horizontal direction with respect to the plane, is arranged on the swingable plate unit.

7. The image forming apparatus according to claim 1, wherein the first auxiliary frame has at least one protrusive strip, of which an open end extends along a conveying direction of the sheet.

8. The image forming apparatus according to claim 7, wherein the at least one protrusive strip is formed integrally with the first auxiliary frame.

9. The image forming apparatus according to claim 1, further comprising:

a feeder unit configured to feed the sheet placed on the swingable plate unit toward the photosensitive member; and a third auxiliary frame arranged in a position to face the first auxiliary frame across the conveying path and configured to support the feeder unit, the third auxiliary frame being fixed to the main frames.

10. The image forming apparatus according to claim 9, wherein the third auxiliary frame is made of resin.

11. The image forming apparatus according to claim 9, wherein the feeder unit comprises the pickup roller.

12. The image forming apparatus according to claim 11, wherein the swingable plate unit is swingably movable to press the sheet placed on the swingable plate unit against the pickup roller.

13. The image forming apparatus according to claim 11, wherein the swingable plate unit is swingably moved in cooperation with start and stop rotating motions of the pickup roller.

14. The image forming apparatus according to claim 9, wherein the feeder unit comprises a separator.

15. The image forming apparatus according to claim 14, wherein the separator comprises a separator roller and a separator pad.

16. The image forming apparatus according to claim 1, wherein the second auxiliary frame is made of resin.

17. The image forming apparatus according to claim 1, wherein the swingable panel is movable between the position closer to the pickup roller and the position farther from the pickup roller in cooperation with start and stop rotating motions of the pickup roller.

18. The image forming apparatus according to claim 1, wherein the swingable plate unit further comprises a lifting piece, the lifting piece being arranged below the pickup roller and configured to uplift the swingable panel.

* * * * *